United States Patent [19]

Fränkle et al.

[11] 4,389,987

[45] Jun. 28, 1983

[54] CONTROL MEMBER FOR FUEL INJECTION DEVICES

[75] Inventors: Gerhard Fränkle, Remshalden; Friedrich-Wilhelm Hase, Stuttgart, both of Fed. Rep. of Germany

[73] Assignee: Daimler-Benz Aktiengesellschaft, Stuttgart, Fed. Rep. of Germany

[21] Appl. No.: 133,410

[22] Filed: Mar. 24, 1980

[30] Foreign Application Priority Data

Mar. 23, 1979 [DE] Fed. Rep. of Germany ..... 2911447

[51] Int. Cl.[3] ..... F02M 45/06

[52] U.S. Cl. ..... 123/300; 123/462; 417/493

[58] Field of Search ..... 123/299, 300, 462, 460; 239/533.4; 417/510, 493, 498

[56] References Cited

U.S. PATENT DOCUMENTS

| | | | |
|---|---|---|---|
| 3,392,715 | 7/1968 | Thoma | 123/299 |
| 3,394,891 | 7/1968 | Voit | 123/299 |
| 3,438,359 | 4/1969 | Thoma | 123/300 |
| 3,481,315 | 12/1969 | Thornber | 123/460 |
| 4,259,040 | 3/1981 | Scheying | 123/300 |

FOREIGN PATENT DOCUMENTS

| | | | |
|---|---|---|---|
| 810456 | 3/1959 | United Kingdom | 123/300 |

*Primary Examiner*—Charles J. Myhre
*Assistant Examiner*—Carl Stuart Miller
*Attorney, Agent, or Firm*—Craig & Burns

[57] ABSTRACT

A control member for regulating a flow of fuel to fuel injection devices of an air-compressing internal combustion engine. The control member is adapted to be arranged in one of a zone of the injection valve or within the injection valve. The control member includes a flow-controlling axially movable control piston having an axial bore with the control piston being urged, by a compression spring, into an end position for preventing a full flow of fuel through the control member. A spring chamber is provided for accommodating the compression spring with a throttle being arranged in an end face of the control piston, which throttle communicates the inlet line means with the spring chamber through the axial bore in the control piston. An arrangement is provided for minimizing an open volume of the spring chamber and at least one first bore is provided in the control piston for selectively communicating the axial bore with the outlet duct. A control edge arrangement is provided for controlling an opening and closing of the first bore with the control edge being arranged so as to close the first bore after the control piston is axially displaced over a predetermined portion of a working stroke. A throttle bore, in communication with the axial bore, is provided in the control means at a position offset in a longitudinal direction of the control piston with respect to the first bore. At least one second bore is provided in the control piston in a position offset in a longitudinal direction of the control piston with respect to a further throttle bore in a direction toward an end face of the control piston.

15 Claims, 1 Drawing Figure

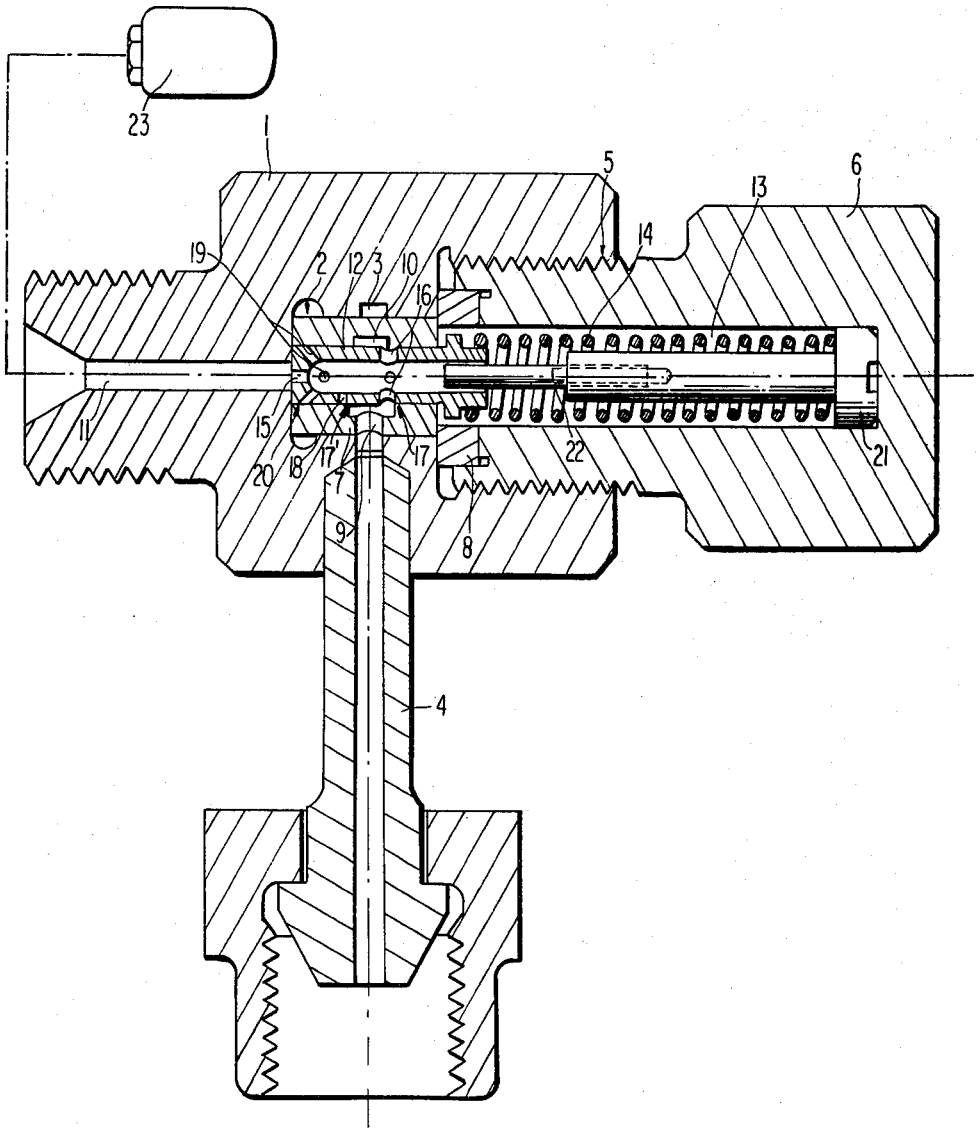
23
1
5
6
13
14
19
2
12
3
10
16
11
15
20
18
17'
17
7
9
8
22
21
4

CONTROL MEMBER FOR FUEL INJECTION DEVICES

The present invention relates to a fuel injection arrangement and, more particularly, to a control member for regulating a flow of fuel to fuel injection devices of an air-compressing internal combustion engine.

A control member is normally arranged in an area of the injection valve or within the injection valve proper with the control member containing a flow-controlling, axially movable control means such as a piston having an axial bore. The control piston may generally be urged by a compression spring into an end position opposed to a through flow or pass through direction wherein only a cross section of a first throttle bore, arranged in an end face of the piston facing in an intake direction of the fuel, is open. The control piston is adapted to execute a defined working stroke against the force of the compression spring in the flow direction upon each injection cycle and, during the execution of the working stroke, the controlled insertion of differing flow cross sections is effected, wherein an outlet conduit or duct leading to the injection valve and controlled by the control piston terminates radially in a housing guiding the control piston, and wherein a volume displaced from the spring chamber accommodating the compression spring during the working stroke of the piston is conducted, by way of alternating inserting cross sections, into the outlet duct or conduit whereby a yielding velocity of the control piston during the working stroke is determined.

A control arrangement of the aforementioned type is proposed in, for example, Offenlungsschrift 1,567,516, wherein it is proposed to arrange two control pistons in series with each piston being acted upon by a compression spring. As can readily be appreciated, this proposal results in a very complicated structure which is trouble prone and expensive.

The aim underlying the present invention essentially resides in providing a control member for regulating a flow of fuel to fuel injection devices of an air-compressing internal combustion engine wherein the control member is constructed in such a way that only a single control piston is required.

In accordance with advantageous features of the present invention, a spring chamber is provided which is restricted as far as possible to a minimum open volume by means of a displacement pin and, at the beginning of the working stroke of the control piston, several bores, located in the control piston, are uncovered which have no throttling action or a low throttling action. The bores are controlled so as to be shut off by means of a control edge after about 10–20% of the working stroke. Thereafter, there is arranged at least one further throttle bore located in the control piston which is off set with respect to the first mentioned bores and, in a direction toward an inlet end face of the control piston, off set with respect to the throttle bore or bores, there are arranged several bores having no throttling effect or a low throttling effect.

By virtue of the arrangement of several differing throttle bores in a single control piston in accordance with the present invention, which bores may be inserted or covered up in dependence upon a position of the control piston, the desired control of the fuel feed may be attained with a substantially simplified device. Moreover, the amount of fuel conveyed in a throttled fashion is dimensioned by way of the diameter of the control piston and the stroke of the piston until a release occurs by the large flow cross section at the control edge, i.e., a pressure reduction. Furthermore, the bores uncovered at the beginning of the working stroke provide a rapid pressure build up until the nozzle opening pressure is obtained at the injection valve.

Advantageously, in accordance with the present invention, the open volume of the spring chamber determined by the displacement pin regulates the extent of fuel storage in the spring chamber.

In accordance with additional advantageous features of the present invention, the last bores which become effective may be arranged at an inclination with respect to a longitudinal extension of the control piston in such a way that the external bore orifices lying in the cylindrical surface of the control piston have a maximally large axial distance with respect to the throttle bore. This arrangement leads to an inclined position of the bore in the direction of the top of the piston. By means of this inclined position, the pressure reduction is initiated only in the final phase of the injection process.

Advantageously, in accordance with the present invention, the displacement pin may exhibit a displacement neck on the end face thereof facing the control piston with the neck being adapted to enter an axial bore of the control piston and being adapted to be adjustable in an axial direction with respect to the displacement pin whereby the volume of the spring chamber may be varied.

Moreover, according to the present invention, at least one reservoir means is provided which is in communication with an inlet line in or at the injection system and, preferably, in a flow direction upstream of the control piston.

By virtue of the disposition of a reservoir such as proposed by the present invention, the steepness of the pressure wave arriving at the control piston may be adjusted and simultaneously the load on the injection pump can be maintained at a small value. A similar effect may also be attained by a corresponding arrangement and configuration of the bores in the control piston.

Since all of the bores in the arrangement of the present invention are provided in one control piston it is readily possible, by exchanging the control piston, to selectively vary the characteristic of the control pressure during an injection step and/or to optimally adapt such characteristic to the given requirements of the air-compressing internal combustion engine.

A special advantage of the present invention resides in the fact that a pressure wave coming from the injection pump is positively reflected on the end face of the control piston so that, due to the addition of amplitudes of the pressure, a high energy level is available during the opening of the control piston so as to effect a rapid injection of residual fuel whereby, in spite of the throttling injection at the onset thereof, the result is only insubstantially longer injection times than is the case in an injection system of a conventional type of construction.

Accordingly, it is an object of the present invention to provide a control member for regulating a flow of fuel to fuel injection devices of an air-compressing internal combustion engine which avoids, by simple means, shortcomings and disadvantage encountered in the prior art.

Another object of the present invention resides in providing a control member for regulating a flow of fuel to fuel injection devices of an air-compressing internal combustion engine which is simple in construction and therefore relatively inexpensive to manufacture.

Yet another object of the present invention resides in providing a control member for regulating a flow of fuel to fuel injection devices of an air-compressing internal combustion engine which enables a rapid pressure build-up until a nozzle opening pressure is obtained at the injection valve.

A further object of the present invention resides in providing a control member for regulating a flow of fuel to fuel injection devices of an air-compressing internal combustion engine which ensures an accurate regulation of fuel storage.

A still further object of the present invention resides in providing a control member for regulating a flow of fuel to fuel injection devices of an air-compressing internal combustion engine which ensures an initiation of a pressure reduction only in a final phase of an injection process.

Another object of the present invention resides in providing a control member for regulating a flow of fuel to fuel injection devices of an air-compressing internal combustion engine which is readily adaptable to specific characteristics of various internal combustion engines.

These and other objects, features, and advantages of the present invention will become more apparent from the following description when taken in connection with the accompanying drawing which shows, for the purposes of illustration only, one embodiment in accordance with the present invention, and wherein:

The single FIGURE is a partially schematic longitudinal cross sectional view of a control member for regulating a flow of fuel to fuel injection devices of an air-compressing internal combustion engine in accordance with the present invention.

Referring now to the single FIGURE of the drawings, according to this FIGURE, a housing part 1 is provided with a cylindrical bore generally designated by the reference numeral 2, with the bore being in communication with an outlet duct or conduit 4 by way of an annular recess 3. During operation, the outlet duct 4 is connected to an intake of an injection nozzle (not shown) which includes a spring loaded valve element for controlling a flow of fuel through the opening of the injection nozzle. The cylindrical bore 2 has an enlarged diameter at the outer end thereof and is provided with an internal thread generally designated by the reference numeral 5 to accommodate a closure member 6.

A cylinder generally designated by the reference numerals 7, forming a precise seal with respect to the housing 1, is inserted into the cylindrical bore 2 and is fixed in its position by the closure member 6 through a sealing ring 8 in such a manner that at least one passage 9, provided in the cylinder 7, terminates in the recess 3 and in the outlet duct 4 in a fitting fashion. An annular groove 10 is arranged in the cylinder 7 with the annular groove 10 defining control edges generally designated by the reference numerals 17 and 17'. An inlet conduit 11 in the housing 1 provides a connection between the cylindrical bore 2 and injection lines (not shown) extending to an injection pump (not shown).

An axially displaceable control piston 12, provided with an axially extending bore 12', is arranged in the cylinder 7. The control piston 12 is acted upon or is under the effect of a compression spring 14, disposed in a spring chamber 13 provided in the closure member 6. The control piston 12 includes a throttle bore 15 in an end face thereof facing the intake direction of the housing 1, i.e., facing the inlet conduit 11. Several bores 16, having no throttling effect, are arranged in the control piston 12. The bores 16 are adapted to be controlled so as to be closed at a beginning of a working stroke of the control piston 12 by means of the control edge 17 of the annular groove 10 after about 10–20% of the working stroke.

At least one further throttle bore 18 is arranged in a direction toward the end face of the control piston 12. The at least one throttle bore 18 has approximately the same diameter as the first throttle bore 15. Additional bores, having no throttling effect, are provided along a further extension of the control piston near the intake end face of the control piston 12. The additional bores 19 are arranged at an inclination with respect to a longitudinal extension of the control piston 12 in such a manner that the external bore orifices of the additional bores 19 have a maximally large axial spacing with respect to the throttle bore 18. A sealing surface 20 on a cylinder wall of the control piston oriented toward the end face of the control piston 12 must be entirely preserved.

A displacement pin 21 is arranged in the spring chamber 13. The displacement pin 21 includes, on an end face thereof facing the control piston 12, a displacement neck 22 extending into the axial bore 12' of the control piston 12 whereby an open volume of the spring chamber 13 is minimized.

At least one reservoir 23 is provided within or at the injection system, with the reservoir 23 being adapted to be in communication with the inlet conduit or line 11 preferably upstream of the control piston 12 as viewed in the flow direction of fuel to the injection nozzle.

The control member of the present invention operates in the following manner.

Fuel, fed from the injection pump, is directed to the inlet conduit or line 11 and acts on the end face of the control piston 12 so as to shift the control piston 12 against the action of the compression spring 14, while only a relatively small quantity of the introduced fuel may flow through the throttle bore 15 into the axial bore 12' of the control piston 12. By virtue of the axial displacement of the control piston 12 against the action of the compression spring 14, a portion of fuel present in the spring chamber 13 is displaced and passes through the bores 16 without a throttling effect, through the passage 9 in the cylinder 7, and through the outlet duct 4 to the injection valve.

By the axial displacement of the control piston 12, and more particularly, approximately after a 10–20% displacement in the working stroke direction, the bores 16 are closed by the control edge 17 of the annular groove provided in the cylinder 7 while the throttle bore 18 is opened or vented by the control edge 17' so that thereafter fuel may flow into the outlet duct 4 only by way of the throttle bore 18.

If several throttle bores 18 are provided, the respective throttle bores may be closed or opened either simultaneously or in succession by means of the control edges 17, 17'; however, it is also possible to arrange these several throttle bores 18 at a predetermined spacing so that the fuel feed to the injection nozzle is temporarily completely interrupted, whereby a corresponding pressure rise is effected in the inlet duct 11 and in the spring chamber 13, and the exiting amount of fuel is delayed and/or maintained at a small amount until the control piston 12 has reached almost the end of the working stroke, and the bores 18, 19 having no or only a small throttling effect are open with respect to the annular groove, whereupon an increased amount of fuel exits from the spring chamber 13 into the outlet duct 4 and a rapid pressure reduction occurs in the spring chamber 13.

Once the end face of the control piston 12 has reached or goes beyond the control edge 17', the inlet conduit 11 is directly connected to the outlet duct 4 whereby the residual injection quantity is provided rapidly and without throttling from the high pressure level ambient in the inlet conduit 11. The compression spring 14 may thereafter return the control piston 12 into its initial position.

The fuel volume which is reduced in the spring chamber 13 when the control edge 17' is passed over by the control piston 12 is replaced, in the period of time until the next working cycle, from the injection line, i.e., an extension of the inlet conduit 11 by way of the throttle bore so that the pressure wave arriving at the next operating cycle is fully supported due to the throttle actions at the bores 16, 18, and 19, respectively, on the compression spring 14 and on the fuel cushion present in the spring chamber 13.

While we have shown and described only one embodiment in accordance with the present invention, it is understood that the same is not limited thereto but is susceptible of numerous changes and modifications as known to one having ordinary skill in the art, and we therefore do not wish to be limited to the details shown and described herein, but intend to cover all such modifications as are encompassed by the scope of the appended claims.

We claim:

1. A control member for regulating a flow of fuel to fuel injection means for an air-compressing internal combustion engine, the control member is adapted to be arranged in one of a zone of an injection valve or within the injection valve, the control member includes a flow controlling axially movable control means having an axial bore, spring means for urging the control means into an end position preventing a full flow of fuel through the control member, a spring chamber means for accommodating the spring means, a throttle means arranged in an end face of the control means facing an intake line means of the control member, the throttle means is arranged so as to communicate the inlet line means with the spring chamber means through the axial bore when the control means is in the end position, and means provided in the control member for enabling fuel from the intake line means to flow through the axial bore to an outlet duct leading to an injection valve upon a predetermined axial displacement of the control means in a working stroke direction against a force of the spring means during each injection cycle, characterized in that means are provided for minimizing an open volume of the spring chamber means, at least one first bore means is provided in the control means for selectively communicating the axial bore with the outlet duct, a control edge means is provided for controlling an opening and closing of the first bore means, the control edge means is arranged so as to close the first bore means after the control means is axially displaced over a predetermined portion of the working stroke, at least one further throttle bore means in communication with the axial bore is provided in the control means at a position offset in a longitudinal direction of the control means with respect to the first bore means, and in that at least one second bore means is provided in the control means at a position offset in a longitudinal direction of the control means with respect to the further throttle bore means in a direction toward the end face of the control means.

2. A control member according to claim 1, characterized in that the control means includes a single control piston, and in that means are provided for axially guiding the control piston in a housing of the control member.

3. A control member according to claim 2, characterized in that the at least one first bore means and the at least one second bore means are formed as unthrottled bore means.

4. A control member according to claim 2, characterized in that the at least one first bore means and the at least one second bore means provide a low throttling action.

5. A control member according to one of claims 1, 2, 3, or 4, characterized in that a plurality of first bore means and a plurality of second bore means are provided in the control means, and in that the predetermined portion of the working stroke is between about 10%–20% of a total working stroke of the control means.

6. A control member according to claim 5, characterized in that the means for minimizing an open volume of the spring chamber means includes a displacement pin means cooperable with said control means.

7. A control member according to claim 6, characterized in that the plurality of second bore means are arranged at an inclination with respect to a longitudinal center axis of the control means such that external apertures of the respective bore means have a maximally large axial spacing from the further throttle bore means.

8. A control means according to claim 7, characterized in that the displacement pin means includes a displacement neck portion adapted to be inserted into the axial bore of the control means, and in that means are provided for axially adjusting the displacement neck portion with respect to the displacement pin means.

9. A control means according to claim 8, characterized in that at least one fuel reservoir means is in communication with the inlet line means of the control member, and in that the fuel reservoir means is disposed upstream of the control means, as viewed in a flow direction of the fuel.

10. A control means according to claim 9, characterized in that the reservoir means is disposed within the fuel injection means.

11. A control means according to claim 2, characterized in that the means for guiding the control piston includes a cylinder accommodated in a bore of a housing of the control member, an annular groove means is provided in the cylinder for defining a pair of spaced edge means, the at least one first bore means communicates the axial bore with the annular groove means, and in that the means for enabling the fuel to flow from the intake line means to the outlet duct includes an annular recess means provided in the housing of the control member and a radially extending passage means for communicating the annular groove means with the outlet duct.

12. A control means according to claim 11, characterized in that the at least one first bore means is arranged in the control means so that, when the control means is in the end position, the communication between the first bore means and the annular groove means is open.

13. A control means according to claim 12, characterized in that a plurality of first bore means and a plurality of second bore means are provided in the control means, and in that the predetermined portion of the working stroke is between about 10%-20% of a total working stroke of the control means.

14. A control means according to claim 13, characterized in that the at least one first bore means and the at least one second bore means are formed as unthrottled bore means.

15. A control means according to claim 13, characterized in that the at least one first bore means and the at least one second bore means provide a low throttling action.

* * * * *